US008621905B2

(12) United States Patent
Brückner et al.

(10) Patent No.: US 8,621,905 B2
(45) Date of Patent: Jan. 7, 2014

(54) APPARATUS FOR PRODUCING INSERTS FOR STEAM GENERATOR TUBES

(75) Inventors: Jan Brückner, Uttenreuth (DE); Martin Effert, Erlangen (DE); Joachim Franke, Nürnberg (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/700,533

(22) PCT Filed: May 9, 2011

(86) PCT No.: PCT/EP2011/057419
§ 371 (c)(1),
(2), (4) Date: Nov. 28, 2012

(87) PCT Pub. No.: WO2011/151133
PCT Pub. Date: Dec. 8, 2011

(65) Prior Publication Data

US 2013/0067982 A1 Mar. 21, 2013

(30) Foreign Application Priority Data

May 31, 2010 (EP) ..... 10164425

(51) Int. Cl.
*B21F 3/10* (2006.01)

(52) U.S. Cl.
USPC ..... 72/138; 72/143; 72/145; 140/124

(58) Field of Classification Search
USPC ..... 72/138, 143, 145; 140/124
See application file for complete search history.

(56) References Cited

U.S. PATENT DOCUMENTS

| | | | | | |
|---|---|---|---|---|---|
| 2,038,488 | A * | 4/1936 | Gogan | 72/142 |
| 2,845,987 | A * | 8/1958 | McCullough | 72/143 |
| 4,132,094 | A * | 1/1979 | Missioux | 72/14.8 |
| 4,205,543 | A * | 6/1980 | Wright | 72/138 |
| 4,402,205 | A * | 9/1983 | Yakovlev et al. | 72/138 |
| 5,088,192 | A * | 2/1992 | Dempsey | 72/139 |
| 6,470,725 | B1 * | 10/2002 | Boschiero | 72/138 |
| 2002/0011090 | A1 | 1/2002 | Hasegawa | |
| 2008/0245122 | A1 | 10/2008 | Anagnostopoulos | |

FOREIGN PATENT DOCUMENTS

| | | | |
|---|---|---|---|
| EP | 1793164 | A1 | 6/2007 |
| EP | 2184536 | A1 | 5/2010 |
| FR | 1592381 | A | 5/1970 |
| GB | 390347 | A | 4/1933 |
| GB | 748092 | A | 4/1956 |
| GB | 1039490 | A | 8/1966 |

* cited by examiner

*Primary Examiner* — David B Jones

(57) ABSTRACT

An apparatus for producing inserts for steam generator tubes is provided. The apparatus is intended to allow a technically particularly simple production process, and consequently allow particularly high-speed production of inserts. For this purpose, the apparatus includes a winding head with a wire guiding pin, a guiding opening for a former shaft, provided with a number of spiral slots, and a pressure roller, the wire guiding pin, the guiding opening and the pressure roller being arranged in such a way that a tangent of the pressure roller and of a slot of the former shaft and the guiding axis of wire guiding pin substantially coincide.

3 Claims, 3 Drawing Sheets

APPARATUS FOR PRODUCING INSERTS FOR STEAM GENERATOR TUBES

CROSS REFERENCE TO RELATED APPLICATIONS

This application is the U.S. National Stage of International Application No. PCT/EP2011/057419, filed May 9, 2011 and claims the benefit thereof. The International Application claims the benefits of European Patent Office application No. 10164425.0 EP filed May 31, 2010. All of the applications are incorporated by reference herein in their entirety.

FIELD OF INVENTION

The invention relates to an apparatus for producing inserts for steam generator tubes.

BACKGROUND OF INVENTION

A steam generator is a closed, heated vessel or a pressure pipe system used for generating high-pressure and high-temperature steam for heating and industrial purposes (e.g. for operating a steam turbine). If steam outputs and pressures are particularly high, as in energy generation in power plants, for example, water tube boilers are used in which the flow medium—usually water—flows in steam generator tubes. Water tube boilers are also used in solids combustion, as the combustion chamber in which heat is generated by combustion of the respective raw material can be freely configured by the arrangement of tube walls.

Such a steam generator designed as a water tube boiler therefore comprises a combustion chamber whose enclosing wall consists at least partly of tube walls, i.e. steam generator tubes welded together in a gas-tight manner. On the flow medium side, these steam generator tubes, as evaporator heating surfaces, first form an evaporator into which unevaporated medium is introduced and evaporated. The evaporator is usually disposed in the hottest part of the combustion chamber. Possibly provided downstream thereof on the flow medium side is a device for separating water and steam and a superheater in which the steam is further heated beyond its evaporation temperature in order to achieve a high degree of efficiency in a following heat engine such as a steam turbine, for example. Upstream of the evaporator on the flow medium side, a pre-heater (a so-called economizer) is provided which pre-heats feedwater using waste or residual heat, thereby likewise increasing the efficiency of the system as a whole.

Bare tubes or internally finned tubes are used for evaporator heating surfaces in steam generators. Internally finned tubes are used if the flow of the flow medium into the steam generator tubes is to be swirled, which produces a higher velocity of the fluid on the inner surface of the steam generator tubes. The use of said internally finned tubes may be required for various reasons, such as in the case of a low mass flux of the evaporator under full load. Internally finned tubes also need to be used in the case of high heat fluxes (e.g. in drum boilers): here there is a risk of film boiling, i.e. a film of steam forms on the inside of the steam generator tubes which produces a thermally insulating effect in contrast to the well mixed liquid in the case of nucleate boiling. As a consequence, with the heat flux remaining the same, the wall temperature may increase strongly which can result in destruction of the heating surfaces. Not least, internally finned tubes can prevent flow stratification under normal load conditions (e.g. at minimum load in spiral tube steam generators).

The internal finning of the tubes is produced according to the prior art in a cold drawing process. According to the current state of knowledge, internally finned tubes can only be made from materials having a maximum chromium content of 5%. If internally finned tubes made from steels having a higher chromium content are required to be used, e.g. due to the steam parameters being heightened still further to increase the efficiency, the internally finned tubes cannot be produced using the processes currently available. In this case bare tubes can be provided separately with appropriate swirl-generating inserts. These inserts can be produced independently of the bare tubes and can therefore also be made from a different material.

SUMMARY OF INVENTION

The object of the invention is now to specify an apparatus for producing such inserts for steam generator tubes which makes a technically very simple manufacturing process possible and therefore enables inserts to be produced particularly quickly.

This object is achieved according to the invention in that the apparatus comprises a winding head having a wire guiding pin, a guiding opening for a former shaft provided with a number of spiral slots, and a pressure roller, wherein the wire guiding pin, guiding opening and pressure roller are disposed such that a tangent of pressure roller and a slot in the former shaft and the guiding axis of the wire guiding pin essentially coincide.

The invention is based on the consideration that particularly simple production of an insert could be achieved by using particularly simple materials, in particular simple wire, for the production thereof. In order to give said wire the correct insert shape while at the same time making the manufacturing process particularly simple, the wire must be shaped using a former. Because of the elongated, cylindrical shape of a steam generator tube, said former must also have a corresponding shape as a kind of former shaft. Into the former shaft a negative shape of the insert is introduced in the form of slots, so that the insert can be produced by simple molding to shape. In order to be able to perform this molding in an integrated process, a winding head must be used which comprises a wire guiding pin for feeding in a wire, a guiding opening for the former shaft, and a pressure roller for bending the wire. These components must be disposed such that the wire is guided tangentially into a slot in the former shaft by the wire guiding pin. At the same time, a likewise tangentially disposed pressure roller causes the wire to be pressed into the slot.

In an advantageous embodiment, the apparatus comprises a rotary drive assigned to the former shaft and a guide nut disposed coaxially with respect to the guiding opening. The thread of the guide nut engages into the spiral slots of the former shaft so that the rotation of the former shaft by the rotary drive assigned thereto in conjunction with the feeding of the wires into the slots produces an automatic advance of the former shaft through the winding head. For the feeding-in of the wires, the winding head can therefore be rigidly fixed in the apparatus, thereby enabling the insert to be produced in a particularly simple manner.

Depending on requirements, the desired slots in the former shaft can be produced individually e.g. via a machining process (number, pitch, dimensions). Depending on the desired profile of the insert to be produced, the slots can be implemented as a helix in virtually any number. In the case of a multiply wound helix, all the slots provided in the former shaft must be occupiable by a wire in a single operation, so that particularly fast production of the insert is possible. For this purpose the winding head advantageously comprises a plurality of wire guiding pins and pressure rollers, thereby enabling a plurality of slots to be simultaneously occupied by wires as the former shaft moves through the winding head.

To maximize the reliability of the apparatus, the moving parts must always be in smooth-running contact with one another. This applies in particular to the feeding of the wires and the guiding of the former shaft in the winding head. Particularly smooth guiding is possible by ensuring a continuous, sufficient supply of lubricant, e.g. oil. For this purpose, in an advantageous embodiment, the winding head comprises a lubricant supplying device assigned to the guiding pin and/or the guiding opening.

For even better control of the production process, the winding head advantageously comprises a drive device assigned to a wire guiding pin. This allows controlled feeding of the wires by the wire guiding pins, while better supporting thereby the automatic forward movement of the former shaft.

In an advantageous embodiment, such an apparatus is used for feeding the wires to the slots in a method for producing an insert for a steam generator tube, wherein a number of wires are fed to the slots of a former shaft where they are fixed, forming the insert.

In an advantageous embodiment, an insert produced according to the above described method is used in a steam generator tube, i.e. such a steam generator tube is used in a steam generator.

The advantages achieved by the invention are in particular that a particularly simple, fast and inexpensive technical solution for producing an insert in a steam generator tube is now available using an apparatus having a winding head. When an insert is used, internally finned tubes made of steel with a higher chromium content can be produced which are suitable for particularly high steam parameters and therefore a particularly high steam generator efficiency. The insert is inexpensive to produce, as the former shaft can be used for producing the next insert. The significant cost advantages over cold-drawn tubes with internal fins make the use of inserts attractive even in the case of materials containing less than 5% chromium.

BRIEF DESCRIPTION OF THE DRAWINGS

The invention will now be explained in greater detail with reference to the accompanying drawings in which.

Identical parts are provided with the same reference characters in all the figures.

DETAILED DESCRIPTION OF INVENTION

Figure 1:
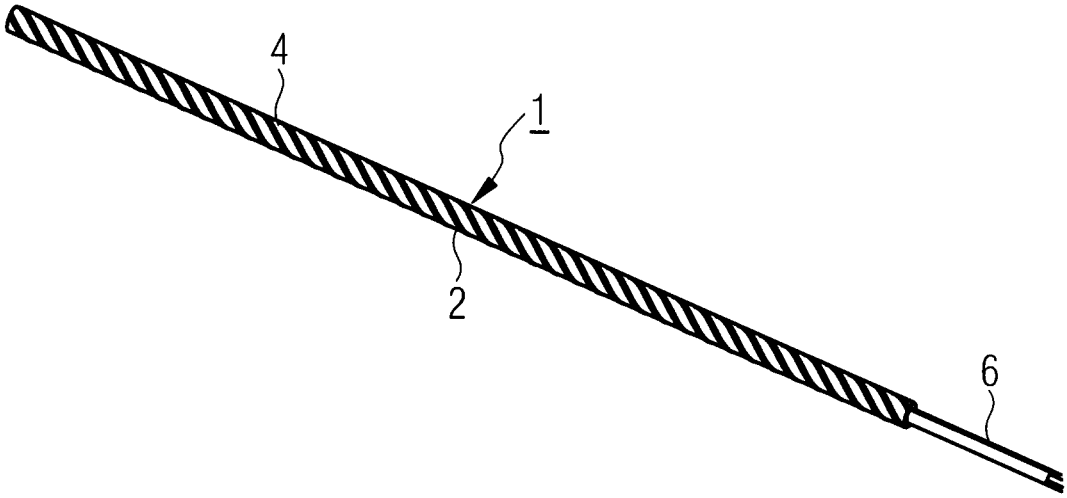
FIG. 1 shows a former shaft for carrying out the method according to the invention

FIG. 1 shows a former shaft 1, the main section 2 of which is provided with spirally circumferential slots 4. The slots 4 are disposed around the cylindrical body of the former shaft 1 in the manner of a triple helix. Depending on the desired profile of the insert to be produced, slots 4 can also be implemented as a double helix or single spirals. Depending on requirements, the desired slots 4 can be produced individually via a machining process (number, pitch, dimensions). The length of the main section 2 of the former shaft 1 is slightly longer than the bare tube in which the insert is to be mounted. Adjacent to the main section 2 of the former shaft 1 in the axial direction is an access section 6 which is not provided with slots 4 and is used for handling the former shaft 1 during the method according to the invention.

Figure 2:
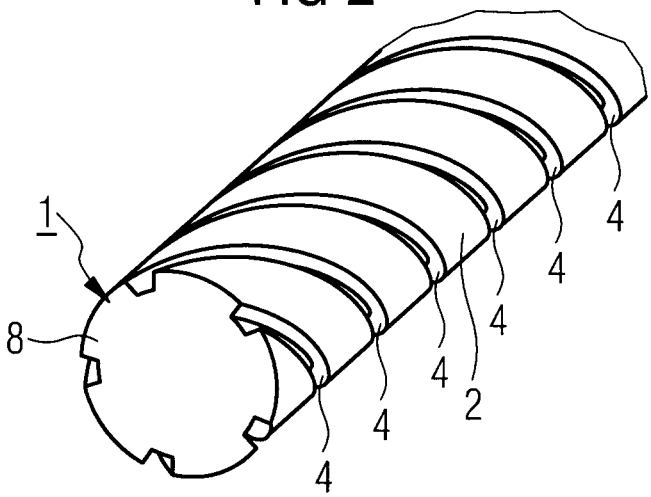
FIG. 2 shows an enlarged sectional view of a former shaft.

FIG. 2 shows an enlarged sectional view of the former shaft 1. The profile of the slots 4 provided in the former shaft 1 is visible at the intersecting plane 8. The slots 4 have a conical profile. Such a profile allows simpler insertion and reverse rotation of the former shaft 1 during the production process of the insert (not shown in greater detail) for a steam generator tube.

Figure 3:
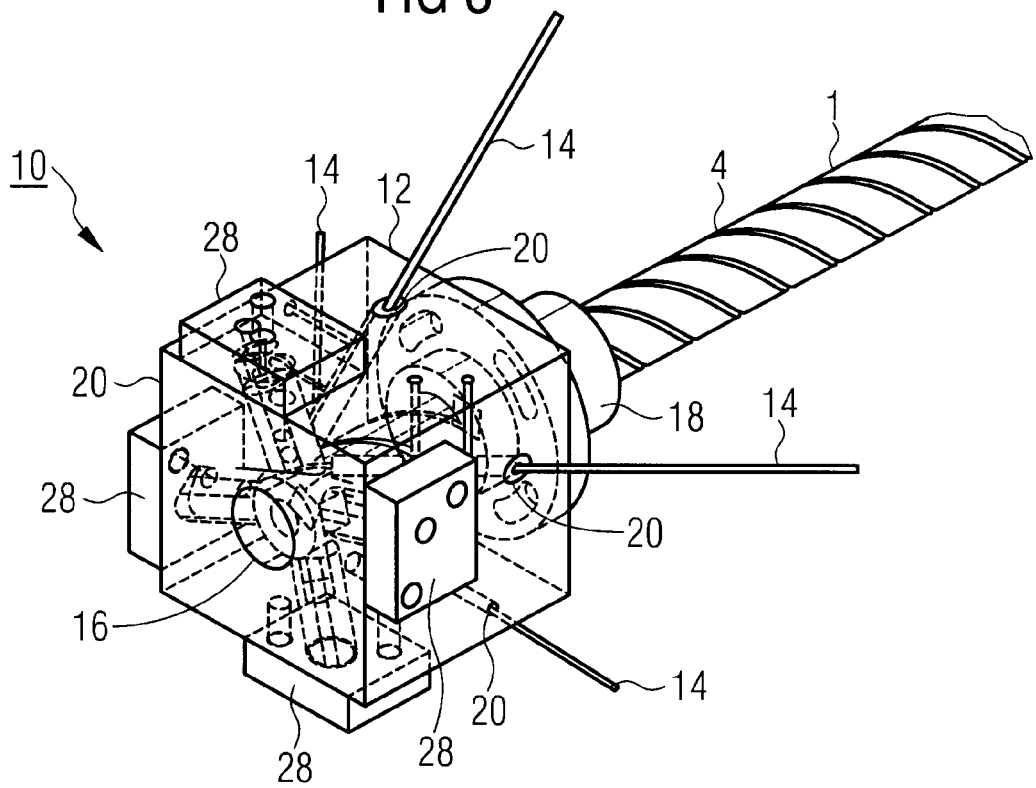
FIG. 3 shows a winding head with former shaft inserted.

FIG. 3 shows an apparatus for producing an insert for a steam generator tube. The apparatus 10 comprises an essentially cubically shaped winding head 12 in which wires 14 are molded to shape in the slots 4 of the former shaft 1 so as to form an insert. The former shaft 1 is guided in a guiding opening 16, wherein a guide nut 18 disposed coaxially with respect to the guiding opening 16 engages in the slots 4 in the former shaft 1 so that, due to the rotation by a rotary drive (not shown in greater detail) acting on the former shaft 1, the latter is moved forward through the winding head 12.

The winding head 12 comprises four cylindrical wire guiding pins 20, so that four wires 14 can be simultaneously inserted in one operation into the slots 4 in the former shaft 1. For an optimum operation, the winding head 12 is optimized to match the geometry of the former shaft 1: the central axes of the wire guiding pins 20 are disposed tangentially to the slots 4 in the former shaft 1.

Figure 4:
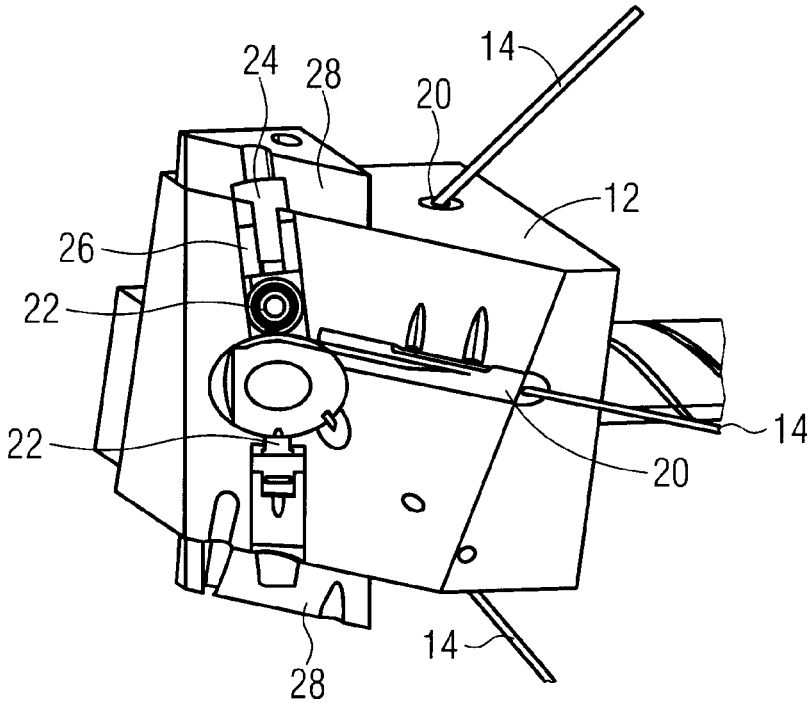
FIG. 4 shows a section through the winding head from FIG. 3, and FIG. 5 schematically illustrates a once-through steam generator of two-pass design.

FIG. 4 shows a section through the winding head 12 along a central axis of a wire guiding pin 20. The bending of the wires 14 around the former shaft 1 is effected by pressure rollers 22 which are likewise disposed tangentially to the central axis of their respectively assigned wire guiding pins 20 and to a slot 4. The amount of pressure exerted by the pressure rollers 22 is adjusted in each case via an adjustment screw 24 in an adjustment thread 26, said adjustment screw 24 being fixed in the axial direction by an adjustment plate 28. Smooth guidance of the former shaft 1 and wires 14 is ensured by lubricant supplying devices not shown in greater detail.

Figure 5:
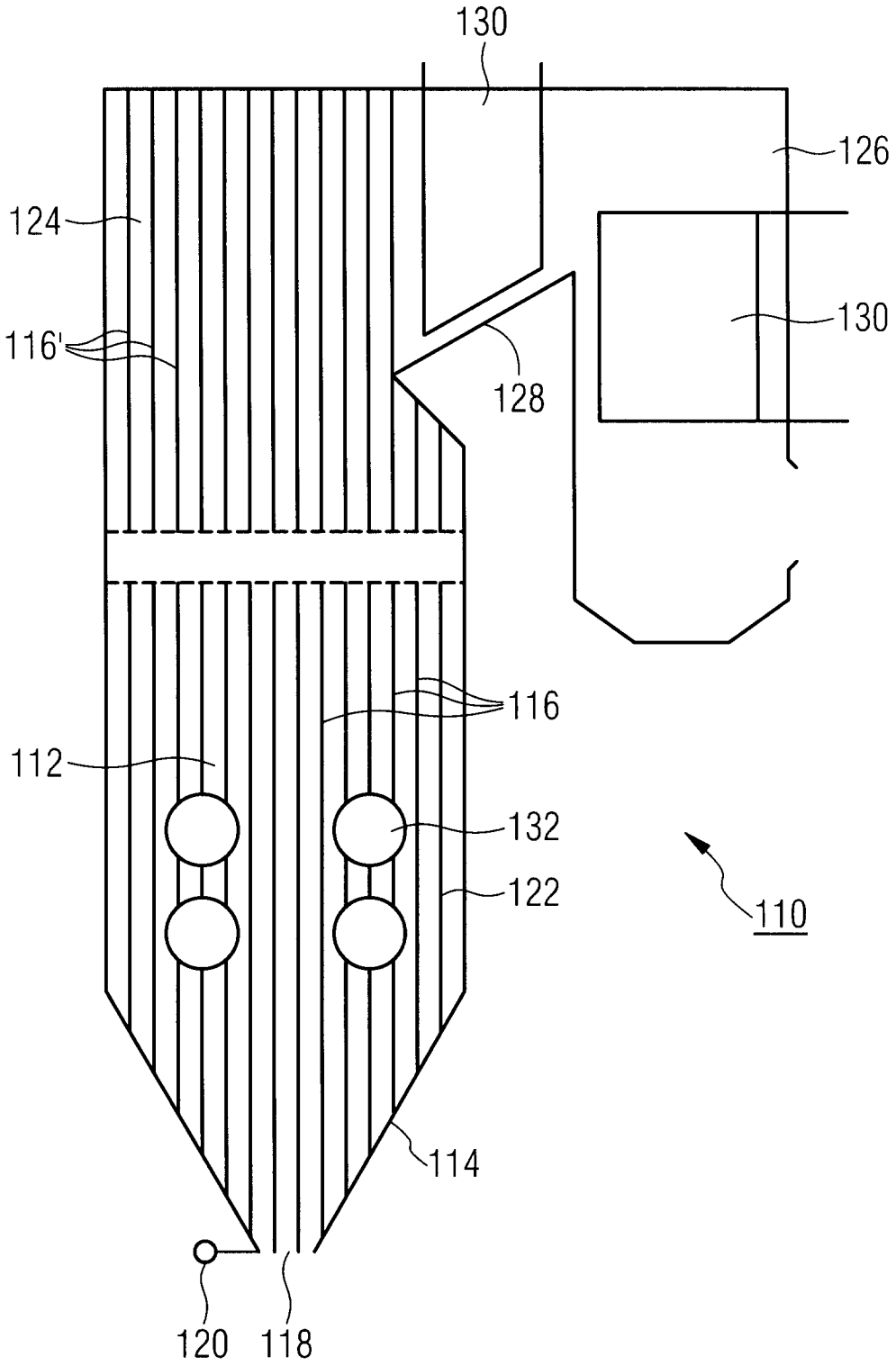

The once-through steam generator 110 according to FIG. 5 is designed as a two-pass steam generator of the vertical tube type. It has an enclosing wall 112 which transitions to a funnel-shaped floor 114 at the lower end of the first gas path constituted by said wall. In a lower region, i.e. evaporator region, the enclosing wall 112 is made up of evaporator tubes 116 and, in an upper region, i.e. superheater region, of superheater tubes 116'. The evaporator tubes 116 and superheater tubes 116' are interconnected in a gas-tight manner, e.g. welded together, on their long sides. The floor 114 comprises a discharge opening 118 for ash (not shown in greater detail).

The evaporator tubes 116 of the enclosing wall 112 through which a flow medium, in particular water or a water/steam mixture, flows from the bottom to the top are connected by their inlet ends to an inlet header 120. On the outlet side, the evaporator tubes 116 are connected to the downstream superheater tubes 116' on the flow medium side via a water separator system nor shown in greater detail.

The evaporator tubes 116 of the enclosing wall 112 form an evaporator heating surface 122 in the section of the gas path between the inlet header 120 and the water separator system. Connected thereto is a reheating or superheater heating surface 124 formed by the superheater tubes 116'. In addition, further heating surfaces 130 merely indicated schematically, e.g. an economizer and convective superheater heating surfaces, are disposed in the second gas path 126 through which the hot gases flow downward and in the transverse path 128 connecting it on the hot gas side to the first gas path.

Mounted in the lower region of the enclosing wall 112 in respective openings 132 in the enclosing wall 112 are a number of fossil fuel burners. In FIG. 5, four openings 132 are visible. At such an opening 132, the evaporator tubes 116 of the enclosing wall 112 are curved to bypass the respective opening 132 and run on the outside of the vertical gas path. These openings can also be provided for air nozzles, for example.

Through the use in the steam generator 110 of finned steam generator tubes having inserts produced using the apparatus 10, it is also possible to use steel with a chromium content of more than 5% for the production thereof. Such steam generator tubes are suitable for particularly high steam parameters, thereby ensuring particularly high steam generator efficiency.

The invention claimed is:

1. An apparatus for producing inserts for steam generator tubes, comprising:

a winding head having a plurality of wire guiding pins and a plurality of pressure rollers;

a guiding opening for a shaft provided with a number of spiral slots; and a rotary drive which drives the shaft to rotate, wherein a wire guiding pin of the plurality of wire guiding pins, the guiding opening and a pressure roller of the plurality of pressure rollers are disposed such that a tangent of the pressure roller and a spiral slot in the shaft as well as a guiding axis of the wire guiding pin essentially coincide, and wherein a guide nut is disposed coaxially with respect to the guiding opening.

2. The apparatus as claimed in claim 1, wherein the winding head comprises a lubricant supplying device which supplies a lubricant to the wire guiding pin and/or the guiding opening ensuring a smooth guiding of a wire and/or the shaft, respectfully.

3. The apparatus as claimed in claim 1, wherein the winding head comprises a drive device which allows controlled feeding of a wire by the wire guiding pin.

* * * * *